United States Patent [19]

Wada

[11] Patent Number: 4,792,649

[45] Date of Patent: Dec. 20, 1988

[54] MULTIPLE PUSH-BUTTON SWITCH ARRANGEMENT

[75] Inventor: Tsuyoshi Wada, Yawata, Japan

[73] Assignee: Matsushita Seiko Co., Ltd., Osaka, Japan

[21] Appl. No.: 124,502

[22] Filed: Nov. 24, 1987

Related U.S. Application Data

[63] Continuation-in-part of Ser. No. 9,347, Jan. 30, 1987, abandoned.

[30] Foreign Application Priority Data

| | | | |
|---|---|---|---|
| Jan. 31, 1986 | [JP] | Japan | 61-20855 |
| Feb. 18, 1986 | [JP] | Japan | 61-34695 |
| Apr. 24, 1986 | [JP] | Japan | 61-95386 |

[51] Int. Cl.[4] ..... H01H 9/20

[52] U.S. Cl. ..... 200/5 E

[58] Field of Search ..... 200/5 R, 5 B, 5 C, 5 D, 200/5 E, 5 EA, 5 EB, 50 C, 159 A; 74/483 PB

[56] References Cited

U.S. PATENT DOCUMENTS

| | | | |
|---|---|---|---|
| 3,100,822 | 8/1963 | Vermeulen | 200/5 EB |
| 3,185,803 | 5/1965 | Driscoll | 200/159 A |
| 3,219,766 | 11/1965 | Sayward et al. | 200/5 EB |
| 3,731,032 | 5/1973 | Schantz | 200/159 A X |
| 3,970,806 | 7/1976 | Distler | 200/5 E X |
| 4,052,580 | 10/1977 | Stanish | 200/159 A X |
| 4,700,586 | 10/1987 | Miura | 200/5 E X |

FOREIGN PATENT DOCUMENTS

| | | |
|---|---|---|
| 56-6088 | 2/1981 | Japan . |
| 60-46621 | 4/1985 | Japan . |

*Primary Examiner*—J. R. Scott

*Attorney, Agent, or Firm*—Cushman, Darby & Cushman

[57] ABSTRACT

A plurality of switch elements are disposed within a casing made of synthetic resin. Each of the switch elements is changeable between a normally-open state and a closed state. A plurality of movable stems are made of synthetic resin. At least parts of the stems extend in the casing and engage the respective switch element. The switch elements are changed between the open and closed states in accordance with movements of the stems respectively. The switch elements can be locked in the closed states. Any one of the switch elements can be unlocked and moved from the closed state when another switch element is changed from the open state to the closed state. At least two of the switch elements are prevented from being simultaneously locked in the closed positions. A mechanism allowing the locking process and unlocking process includes a plate made of synthetic resin and extending within the casing. A mechanism allowing the simultaneously lock preventing process includes a plate made of synthetic resin and extending within the casing. The plates extend in parallel.

3 Claims, 4 Drawing Sheets

MULTIPLE PUSH-BUTTON SWITCH ARRANGEMENT

CROSS-REFERENCES TO RELATED APPLICATIONS

This is a continuation-in-part of application Ser. No. 009,347, filed Jan. 30, 1987, now abandoned.

BACKGROUND OF THE INVENTION

This invention relates to a multiple push-button switch arrangement usable in an electric appliance such as an electric fan.

Some electric appliances are provided with multiple push-button switch arrangements. Conventional multiple push-button switch arrangements have problems in compactness, weight, and assembly.

SUMMARY OF THE INVENTION

It is an object of this invention to provide a compact and light multiple push-button switch araangement.

It is another object of this invention to provide a multiple push-button switch arrangement which can assembled easily.

In a multiple push-button switch arrangement according to a first aspect of this invention, a plurality of switch elements are disposed within a casing made of synthetic resin. Each of the switch elements is changeable between a normal state and an activated state. A plurality of movable stems are made of synthetic resin. At least parts of the stems extend in the casing. The switch elements are changed between the normal and activated states in accordance with movements of the stems respectively. The switch elements can be locked in the activated states. Any one of the swith elements can be unlocked and moved from the activated state when another swith element is changed from the normal state to the activated state. At least two of the switch elements are prevented from being simultaneously locked in the activated positions. A mechanism allowing the locking process and unlocking process includes a plate made of synthetic resin and extending within the casing. A mechanism allowing the simultanous lock preventing process includes a plate made of synthetic resin and extending within the casing. The plates extend in parallel.

In a multiple push-button switch arrangement according to a second aspect of this invention, a box-shaped casing made of synthetic resin has an upper opening. A plurality of sets of fixed and movable contacts are disposed within a lower portion of the casing. An interlink plate made of synthetic resin is inserted through the upper opening into the casing and is placed in a position where the interlink plate extends horizontally. The interlink plate is urged horizontally. A simultaneous lock prevention plate made of synthetic resin is inserted through the upper opening into the casing and is placed in a position where the simultaneous lock prevention plate extends horizontally on the interlink plate. A plurality of stems made of synthetic resin engage the interlink plate and hold the sets of the fixed and movable contacts in mutual electric contact when the stems are depressed. A plurality of push buttons are mounted on upper ends of the stems respectively.

DESCRIPTION OF THE PREFERRED EMBODIMENT

Figure 1:
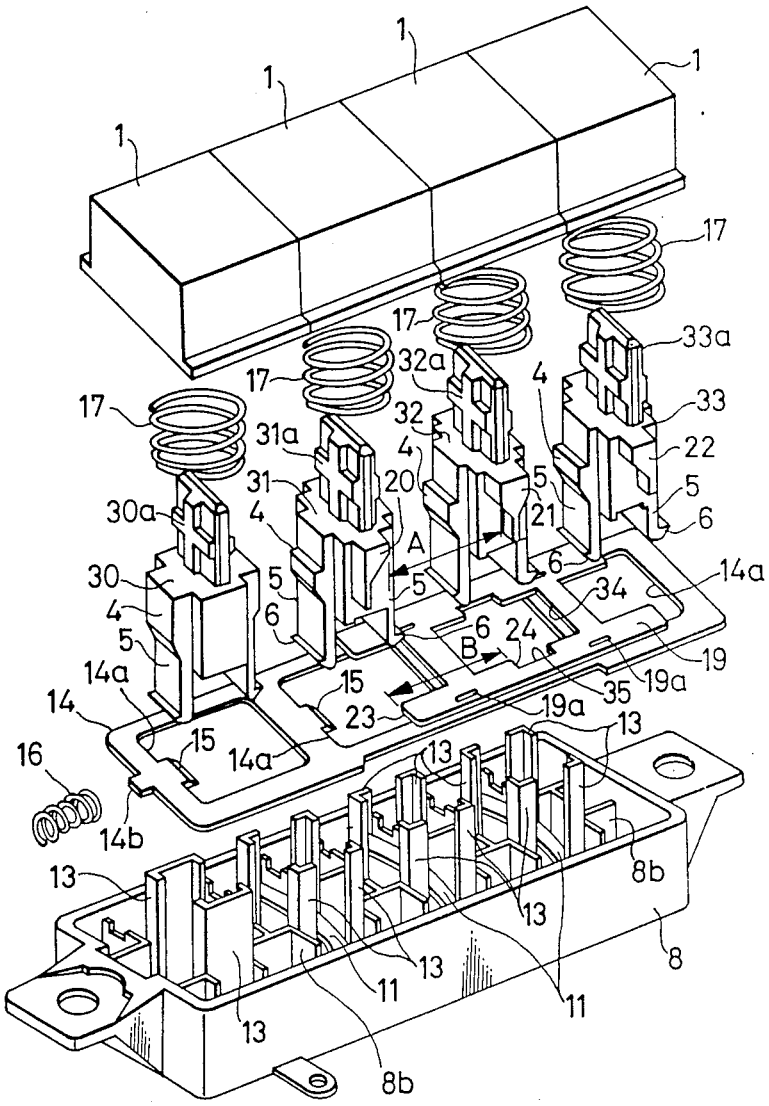
FIG. 1 is an exploded perspective view of a multiple push-button switch arrangement according to an embodiment of this invention.

Prior to the detailed description of this invention, a known multiple push-button switch arrangement will be described below with reference to FIGS. 5–8 for a better understanding of this invention.

As shown in FIGS. 5-8, the known multiple push-button switch arrangement includes a set of buttons 101 each having a groove 102. Each groove 102 extends in a central portion of a lower surface of the related button 101. Metal stems 103 fitted into the respective grooves 102 have projections 104 and longitudinal slots 105. A metal frame 106 has holes 119 through which the respective stems 103 movably extend. Side plates 107 secured to the frame 106 have lower edges 108 extending through holes in a base 109 made of insulating material. The lower edges 108 are pressed and secured to the base 109. In this way, the frame 106 is supported on the base 109 via the side plates 107. A contact member 111 having fixed contacts 110 is secured to the base 109. Movable contact arms 113 are supported on the base 109 by fixing members 121 and have movable contacts 112 corresponding to the respective fixed contacts 110. Opposite ends of an interlink metal plate 114 extend through holes in the side plates 107 so taat the interlink plate 114 is supported on the side plates 107. The interlink plate 114 is movable horizontally relative to the side plates 107. A spring 116 urges the interlink plate 114 relative to on of the side plates 107. The interlink plate 114 has projections 115 in engagement with the respective projections 104 on the stems 103. Plates 117 extending through the respective slots 105 are attached to the stems 103 respectively. The plates 117 have recessed portions 120 in engagement with the contact arms 113. The contact arms 113 have openings accommodating lower ends of the plate 117 respectively. Return springs 118 urge the buttons 101 relative to the frame 106 respectively.

As one of the buttons 101 is depressed downward against the force of the related return spring 118, the associated stem 103 and the plate 117 move downward. The downward movement of the plate 117 forces the related contact arm 113, enabling the associated movable contact 112 to meet the corresponding the fixed contact 110. During the downward movement of the stem 103, the projection 104 on the stem 103 slides along an inclinded surface of the projection 115 on the interlink plate 114, forcing the interlink plate 114 horizontally against the force of the spring 116. When the movable contact 112 meets the fixed contact 110, the projection 104 on the stem 103 passes over a top of the projection 115 on the interlink plate 114 and the spring 116 moves the interlink plate 14 reversely. As a result of the reverse movement of the interlink plate 114, the projection 115 on the interlink plate 114 is located above the projection 104 on the stem 103 so that the stem 103 is held in a locked position where the movable contact 112 connects with the fixed contact 110. In general, the connection between the movable contact 112 and the fixed contact 110 is maintained until another button 110 is actuated.

The known multiple push-button switch arrangement of FIGS. 5–8 is unsatisfactory from the standpoints of compattness, weight, and assembly as described hereinafter. The metal frame 106, the metal stems 103, and the metal interlink plate 114 are heavy and costly. During an assembling process, after the stems 103 are fitted through the holes 119 of the frame 106, the interlink plate 114 is loosely fitted into the holes of the side plate 107. Accordingly, it takes a long time to assemble the switch arrangement. Since the interlink plate 114 extends vertically, the height of the switch arrangement is large.

A multiple push-button switch arrangement of this invention will be described hereinafter with reference to FIGS. 1–4. As shown in FIGS. 1–4, the multiple push-button switch arrangement of this invention includes a set or array of buttons 1 made of synthetic resin and each having a groove 2. Each groove 2 extends in a central portion of a lower surface of the related button 1. Vertical stems 30, 31, 32, and 33 made of synthetic resin and arranged in an array have respective upper portions 30*a*, 31*a*, 32*a*, and 33*a* securely fitted into the respective grooves 2 in the buttons 1. As will be made clear hereinafter, the stems 30–33 are movable vertically. The stems 30–33 are fixed to the respective buttons 1 so that they move together with the respective buttons 1. Each of the stems 30–33 has a pair of downwardly-extending legs 5 having outwardly-projecting edges 6. The legs 5 are resilently deformable or movable. One side of each of the stems 30–33 has a projection 4 extending above one of the legs 5. Each of the stems 31–33 has a rib 7 extending between the pair of the legs 5 and being in contact with a resiliently-movable contact arm 11. Each contact are 11 moves in accordance with vertical displacement of the related stem. The resilience of each contact arm 11 is chosen to return the related stem and button upwards when the button is released from a depression force. The stem 30 is considerably different from the other stem 31–33. The stem 30 exclusively serves as an unlocking device. In general, there is no contact arm related to the stem 30.

A casing 8 made of synthetic resin is in the form of a box, having an open upper end. Fixed contacts 9 accommodated in the casing 8 are secured to a bottom wall 8*a* of the casing 8. Movable contacts 10 opposing the respective fixed contacts 9 are formed on one ends of the movable contact arms 11. The other ends of the movable contact are 11 are fixed to the casing bottom wall 8*a*. The movable contacts 10 and the contact arms 11 are accommodated in the casing 8. The movable contacts 10 connect with and separate from the fixed contacts 9 in accordance with displacements of the contact arms 11 which are induced by vertical movements of the stems 31–33 respectively. Sets of the associated movable contacts 10 and the fixed contacts 9 form respective switch elements; Each switch element is changeable between a normal state where the related movable contact 10 is separate from the corresponding fixed contact 9, and an activated state where the related movable contact 10 connects with the corresponding fixed contact 9. The bottom wall 8*a* of the casing 8 has openings 12 through which the legs 5 of the stems 30–33 extend. The casing 8 is provided with vertical posts 13 being integral with and extending upward from the casing bottom wall 8*a*. The posts 13 are fixed relative to the casing 8. The casing 8 is also provided with ribs 8*b* being integral with and extending upward from the casing bottom wall 8*a*. The ribs 8*b* are fixed relative to the casing 8.

An interlink plate 14 made of synthetic resin extends horizontally within the casing 8. The interlink plate 14 is slidably supported on the ribs 8*b* and is thus movable horizontally relative to the casing 8. The interlink plate 14 has an array of openings 14*a* through which the respective stems 30–33 extend movably. The posts 13 also extend through the openings 14*a*. The dimensions of the stems 30–33 and the openings 14*a*, and the intervals between the posts 13 are chosen so as to allow horizontal displacement of the interlink plate 14. The interlink plate 14 has projections 15 extending into the respective openings 14*a* and each having a tapered or inclinded surface corresponding to a tapered or inclined surface of the projection 4 on the stem. The projections 15 on the interlink plate 14 are engageable with the projections 4 on the stems 30–33 respectively. A spring 16 seated between a side wall of the casing 8 and an end of the interlink plate 14 urges the interlink plate 14 horizontally relative to the casing 8. The spring 16 extends around a projection 14*b* of the end of the inerlink plate 14.

A simultaneous lock prevention plate 19 made of synthetic resin extends immediately above the interlink plate 14 and is slidably supported on the interlink plate 14. The simultaneous lock prevention plate 19 is movable horizontally. The simultaneous lock prevention plate 19 has recessed portions 19*a* defining downward projections in contact with the interlink plate 14. These projections on the simultaneous lock prevention plate 19 allow easy slide of the plate 19 on the interlink plate 14. Inward projections (not shown) on the casing 8 limit or inhibit upward movement of the simultaneous lock prevention plate 19. The simultaneous lock prevention plate 19 has an opening 34 through which the stem 32 and the posts 13 related to the stem 32 extend. The dimensions of the stem 32 and the hole 34, and the intervals between the posts 13 are chosen so as to allow horizontal displacement of the simultaneous lock prevention plate 19. The simultaneous lock prevention plate 19 has at least one recess 35 extending at a side of the hole 34 and opening into the hole 34. At least one sides of the stems 31, 32, and 33 have projections 20, 21, and 22 respectively. The recess 35 serves to accommodate the projection 21 on the stem 32. Lower portions of the projections 20–21 have tapered or inclined surfaces. The distance B (see FIG. 1) between a side 24 of the recess 35 and an edge 23 of the simultaneous lock prevention plate 19 is slightly greater than the distance A (see FIG. 1) between the projections 20 and 21. Similarly, the distance between the other side of the recess 35 and the opposite edge of the simultaneous lock prevention plate 19 is slightly greater than the distance between the projections 21 and 22.

The posts 13 are separated into four grouss supporting and guiding the respective stems 30–33. The posts 13 in each of the groups engage coners of the related stem. During vertical displacement of the stems 30–33, the stems 30–33 slide along the posts 13 and are guided by the posts 13. Horizontal movement of the stems 30–33 is inhibited by the posts 13. Return springs 17 disposed in recesses of the buttons 1 extend around innder walls of the buttons 1 defining the grooves 2. One ends of the return springs 17 engage ceilings of the buttons 1. The other ends of the return springs 17 engage upper ends of the posts 13. In this way, the return springs 17 are seated between the buttons 1 and the posts 13 to urge the buttons 1 and the stems 30–33 upward relative to the casing 8. It should be noted that the posts 13 are fixed to the casing 8. The force of each return spring 17 associated with the stem 31, 32, or 33 is chosen so as to assist the contact arm 11 in returning the related button and stem when the button is released from a depression force. The return spring 17 related to the stem 30 returns the related button and stem when the button is released from a depression force.

Figure 2:
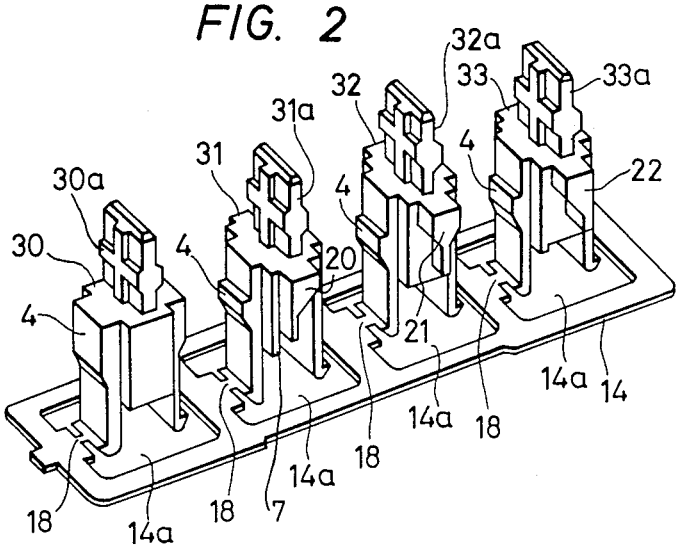
FIG. 2 is a perspective view of the stems and the interlink plate of FIG. 1.
Figure 3:
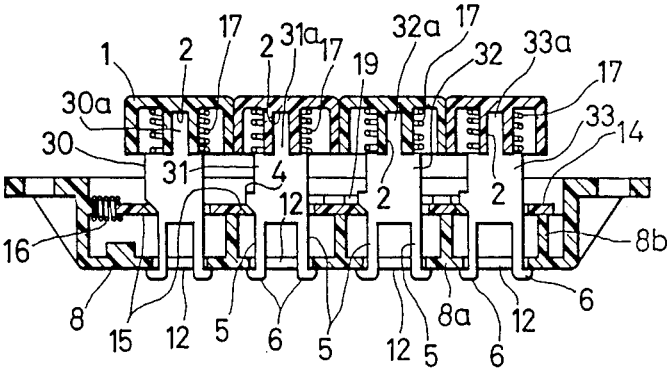
FIG. 3 is a longitudinal cross-sectional view of the multiple push-button switch arragement of FIG. 1.
Figure 4:
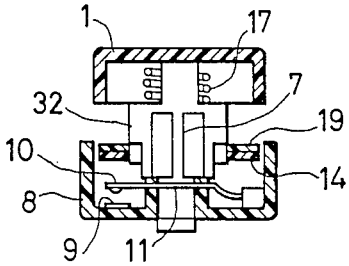
FIG. 4 is a transverse cross-sectional view of the multiple push-button switch arrangement of FIG. 1.
Figure 5:
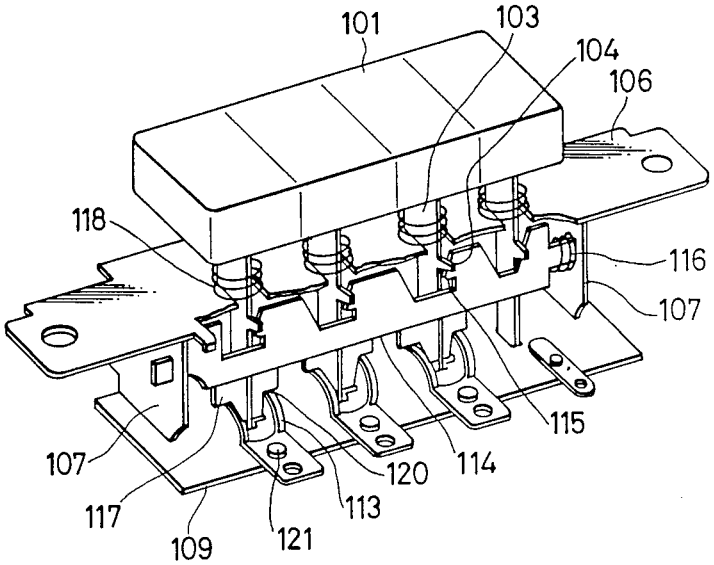
FIG. 5 PRIOR ART
FIG. 5 is a perspective view of a known multiple push-button switch arrangement.
Figure 6:
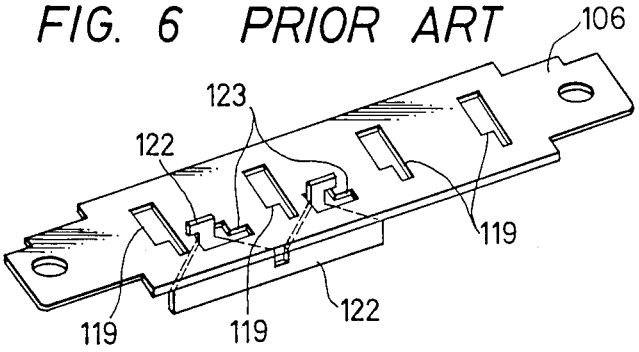
FIG. 6 PRIOR ART
FIG. 6 is a perspective view of the frame of FIG. 5.
Figure 7:
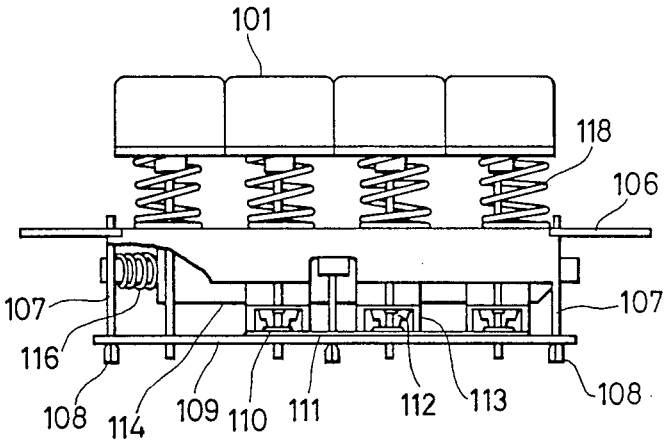
FIG. 7 PRIOR ART
FIG. 7 is a side view of the multiple push-button switch arrangement of FIG. 5.
Figure 8:
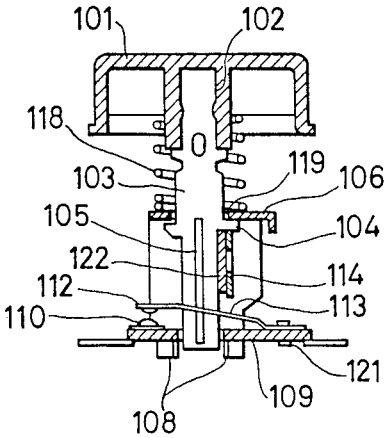
FIG. 8 PRIOR ART
FIG. 8 is a sectional view of the multiple push-button switch arrangement of FIG. 5.

The stems 30–33 and the interlink plate 14 are made integrally in a common molding procsss. As shown in FIG. 2, the stems 30–33 and the interlink plate 14 are originally connected via bridges 18. During assembly of the multiple push-button switch arrangement, the bridges 18 are cut and the stems 30–33 are separated from the interlink plate 14. The integral structure of the stems 30–33 and the interlink plate 14 simplifies manufacture and assembly of the multiple push-button switch arrangement.

The multiple push-button switch arrangement is assembled as follows: The integral combination of the stems 30–33 and the interlink plate 14 is set in a position where the interlink plate 14 extends on the ribs 8*b* of the casing 8. After the bridges 18 are cut and removed so that the stems 30–33 are separated from the interlink plate 14, the stems 30–33 are placed into the casing 8 while they are guided by the posts 13. For example, the bridges 18 are broken off by depression forces applied to the stems 30–33. The stems 30–33 are moved downward until the projecting edges 6 of the stem legs 5 emerge from the bottom openings 12 of the casing 8 and engage the bottom walls of the casing 8. The original distance between the projecting edges 6 of the legs 5 in a pair is slightly greater than the corresponding dimension of each opening 12. The resilience of each leg 5 and a curved or inclined lower surface of each leg 5 allows the projecting edges 6 in the legs 5 in a pair to move through the related opening 12. After the stems 30–33 and the interlink plate 14 are placed in the casing 8, the spring 16 is placed between the casing 8 and the interlink plate 14. The spring 16 is located around the projection 14*b* on the interlink plate 14. Then, the simultaneous lock prevention plate 19 is inserted from above into the casing 8 while it is guided by the posts 13. The simultaneous lock prevention plate 19 is finally placed on the interlink plate 14. After the return springs 17 are placed around the upper portions 30*a*–33*a* of the stems 30–33, the buttons 1 are attached to the stems 30–33 by fitting the upper portions 30*a*–33*a* of the stems 30–33 into the grooves 2 in the buttons 1.

The multiple push-button switch arrangement operates as follows: As one of the buttons 1 related to the stems 31–33 is depressed, the associated stem, for example, the stem 32, moves downward and also the rib 7 on the stem 32 moves downward. The downward movement of the rib 7 depresees the associated contact arm 11, moving the related movable contact 10 into contact with the corresponding fixed contact 9. During a first stage of the downward movement of the stem 32, the projection 4 on the stem 32 remains in contact with the projection 15 on the interlink plate 14 and forces the interlink plate 14 horizontally against the force of the spring 16. The tapered or inclined surfaces of the projections 4 and 15 allow horizontal displacement of the interlink plate 14 with downward movement of the stem 32. During a second stage of the downward movement of the stem 32, when the projection 4 on the stem 32 passes over the projection 15 on the interlink plate 14, the interlink plate 14 is moved horizontally in the opposite direction by the force of the spring 16 so that the projection 15 moves into a position above the projection 4. Accordingly, the interlink plate 14 locks or holds the stem 32 in a depressed position where the contacts 9 and 10 are electrically connected.

It is assumed that the stem 32 is held in its depressed position. When the other stem 30, 31, or 32 is moved downward by depressing the related button 1, the downwardly moving stem forces the interlink plate 14 horizontally against the force of the spring 16 in a manner similar to the previously-mentioned case where the stem 32 forces the interlink plate 14. This horizontal displacement of the interlink plate 14 allows the projection 4 on the stem 32 to move upward through the opening 14*a* of the interlink plate 14 and thus allows the stem 32 to return to an undepressed or normal position where the contacts 9 and 10 are separate. The resilience of the contact arm 11 and the return spring 17 enables return of the stem 32 to its normal position. It should be noted that the stem 30 is designed so as to exclusively act to release the lock of the other stems 31–33.

When depression forces are simultaneously applied to the two buttons 1, the related two stems, for example, the stems 31 and 32 slightly move downward and the projections 20 and 21 on the stems 31 and 32 encounter the edge 23 and the edge 24 of the simultaneous lock prevention plate 19 respectively. It should be noted that the distance A between the projections 20 and 21 is slightly smaller than the distance B between the edges 23 and 24. The encounter between the projections and edges prevents further downward displacements of the stems 31 and 32. In this way, stems 31 and 32 are prevented from simultaneously moving into depressed positions where the related contacts 9 and 10 are connected.

The horizontally-extending structure of the interlink plate 14 and the simultaneous lock prevention plate 19 allows a small height of the multiple push-button switch arrangement. As understood from the previous description, many parts are made of synthetic resin, so that the weight of the multiple push-button switch arrangement can be small.

What is claimed is:

1. A multiple push-button switch arrangement comprising:

(a) a box-shaped casing made of synthetic resin and having an upper opening;

(b) a plurality of sets of fixed and movable contacts disposed within a lower portion of the casing;

(c) a plurality of movable stems made of synthetic resin, at least parts of the stems extending in the casing, each stem holding a respective set of the fixed and movable contacts in mutual electric contact when the stem is depressed and out of contact when the stem is retracted;

(d) a plurality of push buttons mounted on upper ends of the stems respectively;

(e) means for locking a set of the contacts in contact when its respective stem is depressed and for unlocking that set and moving its contacts out of contact when another stem is depressed comprising an interlink plate made of synthetic resin, the interlink plate being inserted through the upper opening into the casing and placed in a position where the interlink plate extends horizontally, the interlink plate being urged horizontally;

(f) means for preventing the contacts of at least two of the sets from being simultaneously locked in contact comprising a simultaneous lock prevention plate made of synthetic resin, the simultaneous lock prevention plate being inserted through the upper opening into the casing and placed in a position where the simultaneous lock prevention plate extends horizontally on the interlink plate; and (g) posts projecting from a bottom wall of the casing in a direction along which the stems are movable, the stems having side projections respectively, the simultaneous lock prevention plate extending outward of the posts and being movable horizontally, the simultaneous lock prevention plate having a groove, wherein the distance between the groove and an edge of the simultaneous lock prevention plate is smaller than the distance between the side projections on the adjacent stems.

2. The arrangement of claim 1 wherein each of the stems has a pair of resilient legs having on distal ends thereof hooks projecting outwardly away from each other, a bottom wall of the casing having a plurality of through holes in which the hooks engage to keep the stems mounted in the casing, and further comprising a plurality of movable contact plates having one ends fixed to the casing and supporting the movable contacts, respectively, on other ends thereof, the movable contact plates being positioned between the resilient legs in respective pairs for normally urging the stems upwardly away from the bottom wall, whereby the movable contacts can be brought into and out of electric contact with the fixed contacts by pushing the stems toward the bottom.

3. The arrangement of claim 1 wherein the stems and the interlink plate are initially joined to each other by biidges, then placed together into the casing while they are joined, and thereafter separated from each other by breaking off the bridges under forces applied to push the stems into the casing.

* * * * *